United States Patent [19]

Kimble

[11] Patent Number: 4,698,608

[45] Date of Patent: Oct. 6, 1987

[54] VARIABLE FORCE LINEAR ACTUATOR

[75] Inventor: Jack Kimble, Rancho Santa Fe, Calif.

[73] Assignee: BEI Electronics, Inc., San Francisco, Calif.

[21] Appl. No.: 857,641

[22] Filed: Apr. 29, 1986

[51] Int. Cl.[4] ..... H01F 7/08

[52] U.S. Cl. ..... 335/222; 335/223

[58] Field of Search ..... 335/222, 223, 306, 255, 335/251, 224, 226

[56] References Cited

U.S. PATENT DOCUMENTS

| | | | |
|---|---|---|---|
| 3,467,925 | 9/1969 | Masuda | 335/221 |
| 3,723,779 | 3/1973 | Gillum | 310/13 |
| 3,723,780 | 3/1973 | Gillum | 310/13 |
| 3,743,870 | 7/1973 | Hunt | 310/13 |
| 3,751,693 | 8/1973 | Gabor | 310/13 |
| 3,787,890 | 1/1974 | Bonny | 335/222 X |
| 3,869,930 | 3/1975 | Forest | 335/222 X |

*Primary Examiner*—George Harris

*Attorney, Agent, or Firm*—Limbach, Limbach & Sutton

[57] ABSTRACT

A linear electromechanical actuator having a variable drive force. The actuator includes a moving coil which moves along a stroke path in response to an input current. A magnetic circuit provides a magnetic flux through which the coil is driven. The flux density along the stroke path is non-uniform, with a higher flux density being present only in that region of the stroke path where a higher actuator drive force is required. Thus, less expensive magnetic material can be used. Since the overall flux density in the magnetic circuit is reduced, the dimensions of the soft iron elements of the magnetic circuit can be reduced without magnetic saturation so as to further reduce construction costs.

30 Claims, 5 Drawing Figures

VARIABLE FORCE LINEAR ACTUATOR

FIELD OF THE INVENTION

The subject invention relates generally to electromechanical actuators and more particularly to a linear actuator which provides a variable force with a constant input current over the length of the actuator stroke.

BACKGROUND ART

Linear actuators are electromechanical devices which provide linear mechanical motion in response to an electrical input. In many applications, the magnitude of the force applied by the actuator need not be constant over the full length of the actuator stroke. By way of example, an actuator for the marking pen of an X-Y plotter device must transfer the pen from a home position to the location to be marked. Movement from the home position to the marking position requires a relatively small amount of force and a relatively long translation. Once the pen is in position, the actuator forces the pen against the printing medium, such as paper. In this portion of the stroke, a relatively large amount of force is required to firmly press the pen tip against the medium so that marking is accomplished.

Heretofore, linear actuators have been designed so as to apply a relatively uniform force over the full stroke length for a constant input current. It would be desirable to provide an actuator which is capable of applying a varying force over the length of the stroke in those applications where a constant force is not necessary or not desired.

The present invention is directed to a linear actuator which provides a non-uniform, but controllable force along the length of the stroke. One advantage is that lower performance and, hence, less costly, magnetic material can be used in those locations where a reduced force is adequate. More costly and higher performance magnetic material need be used only in those locations where greater actuating force is necessary.

A further advantage of utilizing high performance magnetic material only where required is that the total flux in the soft iron portions of the magnetic circuit is reduced. As a result, the dimensions of the soft iron members can be reduced without encountering magnetic saturation of the members. Thus, cost is further reduced as is the weight of the actuator. These and other advantages of the present invention will be apparent to those skilled in the art upon a reading of the following Best Mode for Carrying Out the Invention together with drawings.

SUMMARY OF THE DISCLOSURE

An electromechanical actuator, such as a linear actuator, in disclosed. The actuator includes magnetic means for producing a magnetic flux along an actuator stroke path. The flux has a first flux density at a first region along the stroke path and a second flux density, different from the first flux density, at a second region along the path.

The disclosed actuator further includes a coil assembly moveable along the stroke path. The assembly has a coil comprised of at least one conductor which is present in the magnetic flux provided by the magnetic means. When current is supplied to the coil, a magnetic field is produced which opposes the magnetic field generated by the magnet means.

The opposing magnetic fields impart a force to the coil assembly, with the force being proportional to the flux density in the first and second regions along the stroke path. Since the flux density is different in the two regions, the drive force will vary along the stroke path for a fixed coil current.

A low performance and low cost magnetic material can be utilized in that region of the stroke path where a reduced actuator drive force is adequate. A higher performance and more expensive material need be used only in the stroke path region where greater actuator drive force is required.

BEST MODE FOR CARRYING OUT THE INVENTION

Figure 1:
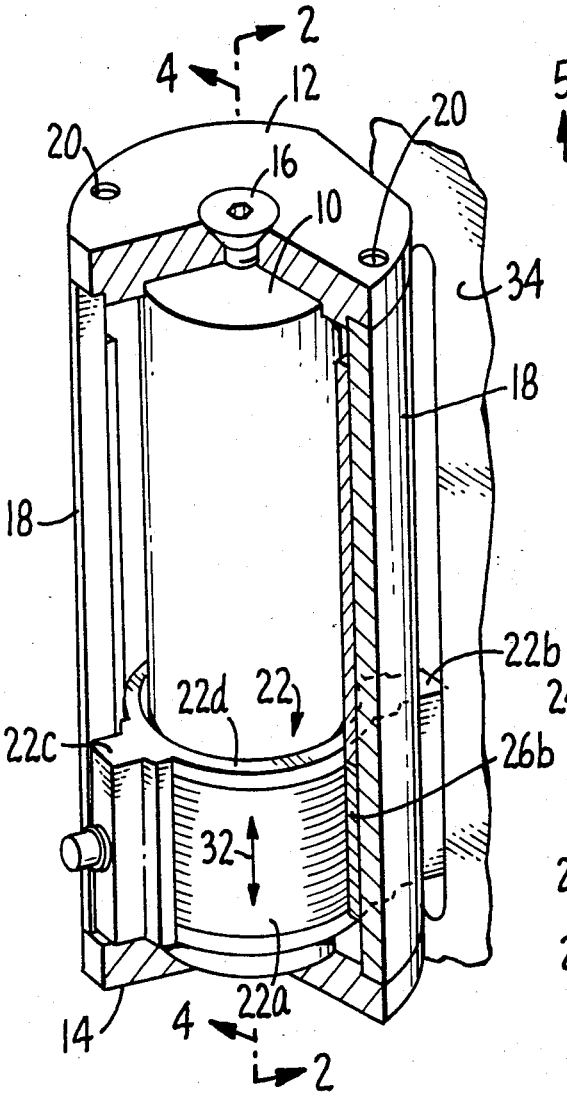
FIG. 1 is an elevational perspective view of a preferred embodiment of the subject invention showing a portion cut away so as to expose the central iron core.

Referring now to the drawings, the subject actuator includes a cylindrical iron core 10. In the present exemplary embodiment, core 10 is approximately 2.6 inches in length and 0.7 inches in diameter. These and other dimensions set forth herein are intended to be exemplary only and can be changed depending upon the particular application.

The actuator further includes a top cap 12 and a bottom cap 14 of soft iron which are secured to the upper and lower ends, respectively, of core 10 by way of screws 16. A circular recess is formed in each cap to receive the respective ends of core 10.

A pair of side plates 18, positioned on opposite sides of core 10, interconnect the top and bottom caps. Side plates 18 are fabricated from soft iron and have a generally arcuate cross-section. The respective ends of the side plates 18 are received by recesses formed in caps 12 and 14 and are secured to the side plates by screws 20.

Figure 3:
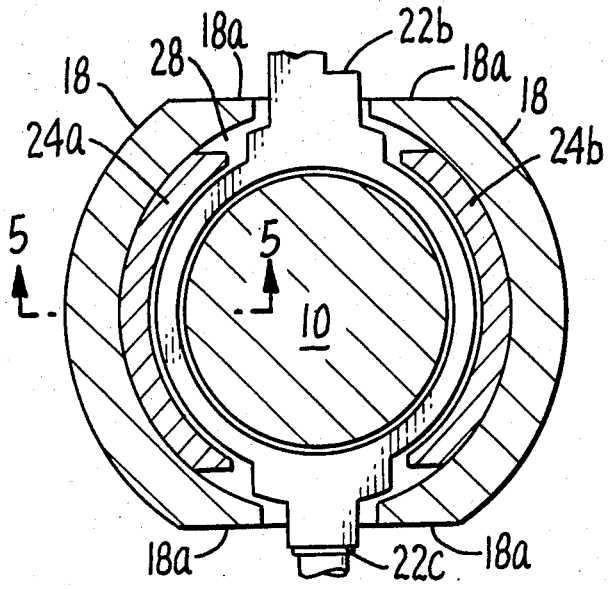
FIG. 3 is a cross-section plan view of the subject invention taken through section line 3—3 of FIG. 2.
Figure 2:
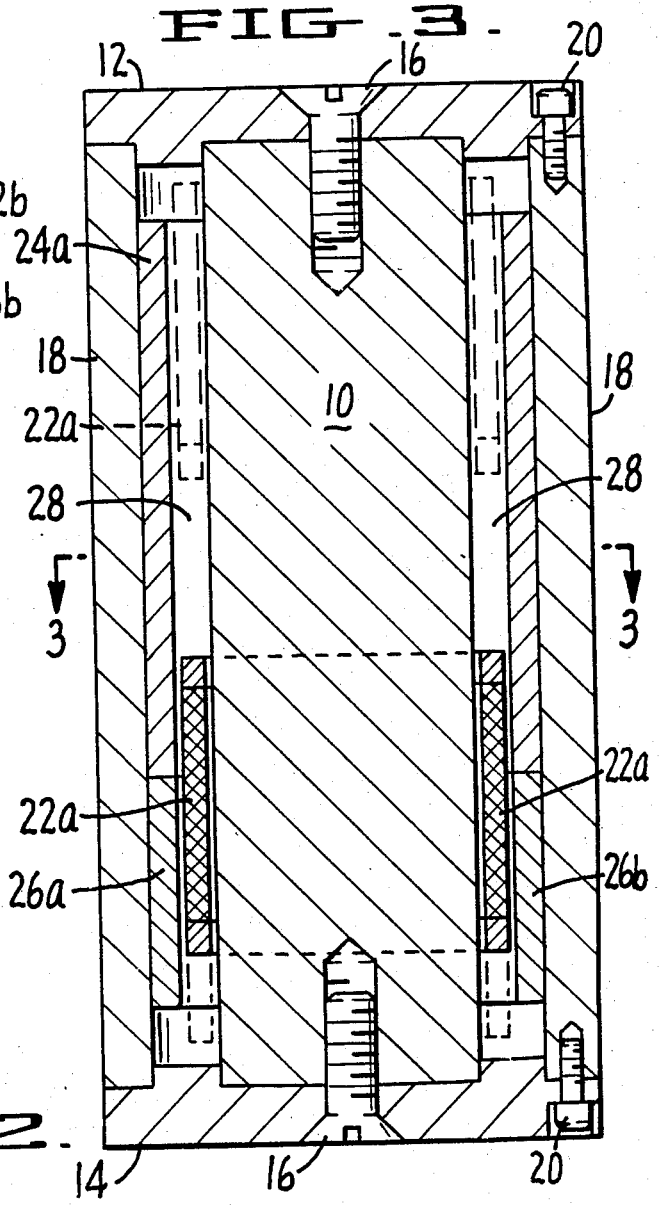
FIG. 2 is an elevational cross-section side view of the subject invention taken through section line 2—2 of FIG. 1.
Figure 4:
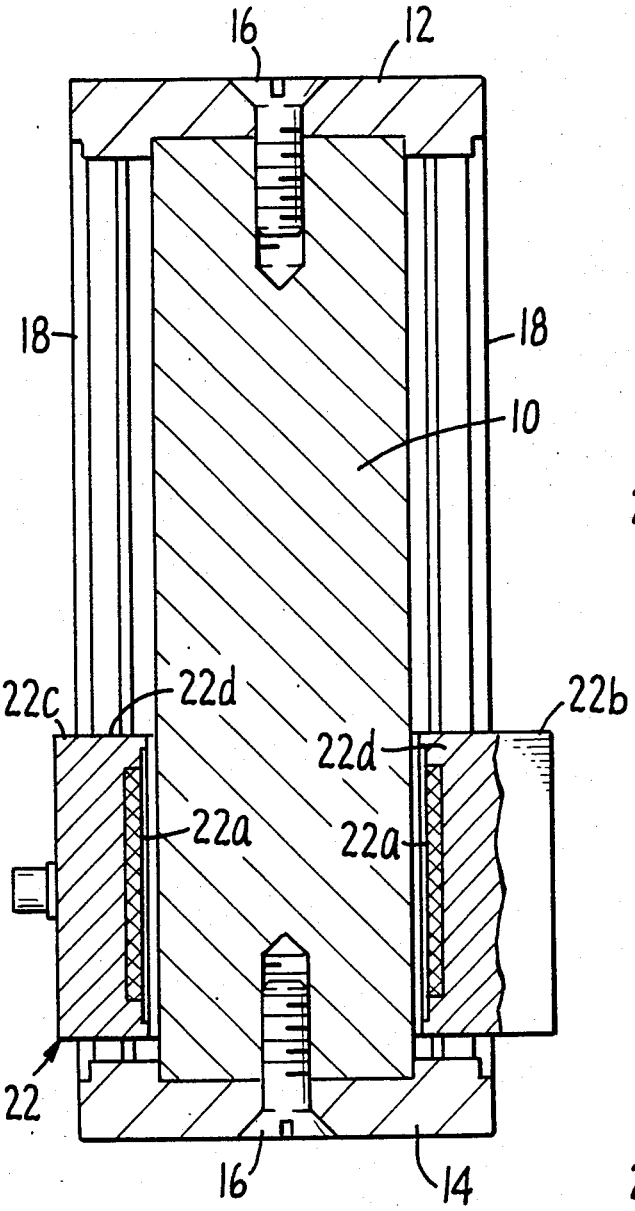
FIG. 4 is a elevational cross-section side view of the subject invention taken through section line 4—4 of FIG. 1.

As can best be seen in FIG. 3, the inner and outer primary surfaces of side plates 18 have a center of curvature which coincides with the longitudinal axis of core 10. Each of the side plates have a bevelled pair of generally planar end surfaces **18*a* that extend along the edges of each plate 18. The plates are positioned so that the opposing surfaces 18*a* of the respective plates are coplanar. A pair of longitudinal slots (not designated) are formed between the edges of side plates 18 for receiving elements of a moving coil assembly 22**, as will be subsequently described.

In the present example, the inner and outer arcuate surfaces, of side plate 18 have a radius of curvature of 0.54 inches and 1.23 inches, respectively. Accordingly, plates 18 are disposed approximately 0.19 inches from core 10.

The subject actuator further includes four magnetic segments. Segments 26a and 26b comprise what can be termed the high performance magnetic segments and segments 24a and 24b comprise the low performance segments of the magnetic segments.

The four magnetic segments are disposed between the side plates 18 and the core 10. The segments have inner and outer primary surfaces with a center of curvature which coincides with the axis of core 10. The inner and outer radii of curvature of the magnetic segments are 0.45 inches and 0.54 inches, respectively. Accordingly, an air gap 28 of a width of approximately 0.10 inches is formed between the magnetic segments and core 10. The outer surfaces of the magnetic segments are abutting the inner surfaces of side plates 18 and are rigidly served in place by a suitable adhesive. Side plates 18, and caps 12, 14 and core 10 function to carry magnetic flux and are preferably fabricated from a ferromagnetic material such as low carbon or cold rolled steel.

As can best be seen in FIG. 3, the magnetic segments are positioned symmetrically with respect to side plates 18. The opposing edges of the segments are spaced apart from one another so as to provide a longitudinal access slot for receiving elements of the moving coil assembly 22. The magnetic segments extends approximately 240° around the circumference of core 10.

The low performance magnetic material of segments 24a, 24b are preferably fabricated from a low cost magnetic material having a relative low energy product. By way of example a plastic bonded Samarium Cobalt material sold by the Epson division of Seiko of Suwa, Japan under the designation Seiko 10A has been found suitable for this application. This material has an energy product of approximately $10^7$ Gauss-Oersteds. A plastic bonded Neodymium Iron Boron material marketed by Xolox, Inc. of Fort Wayne, Ind. under the 7000 series designation and having an energy product of $4\times10^6$ Gauss-Oersteds could also be used, as could other well known low cost magnetic materials.

The high performance magnetic material used in magnetic segments 26a and 26b can be sintered Neodymium Iron Boron having an energy product of approximately $35\times10^6$ Gauss-Oersteds. A sintered Samarium Cobalt material having an energy product of $28\times10^6$ Gauss Oersteds can also be used. Other high performance magnetic materials can be used, depending upon the particular application.

The relatively high performance magnetic segments 26a, 26b are located along only that portion of the actuator stroke path where a relatively high force constant is required. In the present example, segments 26a, 26b have a height of approximately 0.62 inches and are located in the lower section of the actuator. The low performance magnetic segments 24a, 24b are located along that portion of the stroke path where a relatively low force constant is adequate. In the present example, segments 24a, 24b are located in the upper portion of the actuator and have a height of approximately 1.5 inches in the present exemplary embodiment.

The coil assembly 22 includes a coil 22a disposed around core 10. Coil 22a has an inner diameter of approximately 0.78 inches and an outer diameter of approximately 0.89 inches in the present exemplary embodiment. The coil may be formed from 4 layers of 29 gauge copper wire, which provides a total of approximately 188 turns.

In one embodiment, coil 22a is wound around a thin plastic injection-molded form 22d, with the form having upper and lower annual members (not designated) which secure the windings in place.

Assembly 22 further includes a guide member 22b which is attached to form 22d and which extends through the longitudinal slot located between two opposing edges of side plates 18. As can be seen in FIG. 1, when the subject actuator is installed, member 22b is received in a corresponding slot of a mounting element 34 so as to form a linear bearing.

A coil drive member 22c is attached to the coil form 22d, opposite guide member 22b. The drive member extends through the remaining longitudinal slot between side plates 18 and is received in a mounting slot (not depicted) so as to form a second linear bearing. Drive and guide members 22b, 22c provide support for the coil assembly 22 and function to maintain coil 22a concentric with core 10 and spaced apart from the core and the magnetic segments. The members also permit the coil assembly 22 to move freely along the actuator stroke path, which is parallel to the longitudinal axis of core 10, between two extreme positions, as shown in phantom in FIG. 5. Drive member 22c further functions to carry the element to be driven by the subject linear actuator, such as a plotting pen (not depicted).

In order to reduce costs, form 22d can be deleted. In that case, the coil windings are encapsulated using a conventional potting compound. Guide and drive members 22b, 22c are then secured to the encapsulated coil using an adhesive.

Figure 5:
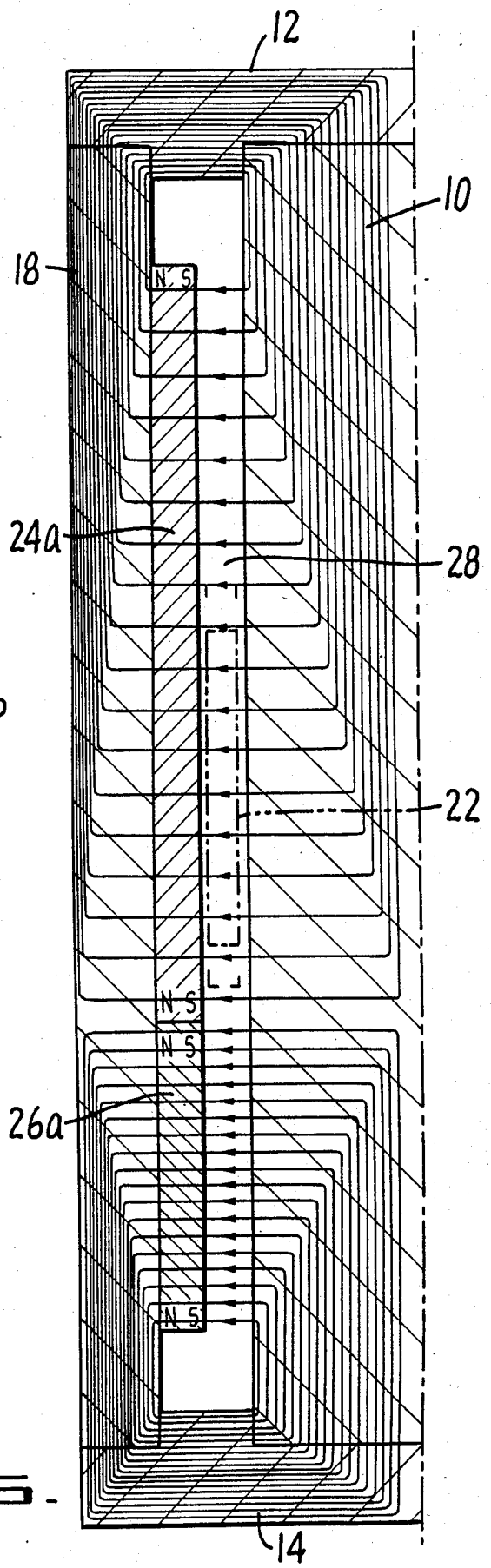
FIG. 5 is a simplified schematic representation of the flux path through the various components of the magnetic circuit of the subject invention.

As can be seen in FIG. 5, the magnetic segments 24a, 24b, 26a, 26b are polarized such that the North/South magnetic axes are radially disposed with respect to the axis of core 10. Accordingly, the flux lines (not designated) will extend from the North Pole of the magnetic segment, to the side plates 18. The flux path continues through plates 18, to either end cap 12 or 14 and across to core 10. The path continues through core 10 and back to the South pole of the magnets by way of air gap 28. Although not depicted in FIG. 5, the magnetic flux of the high performance magnetic segments 26a, 26b extend both through the bottom cap 14 and the top cap 12. Similarly, the flux created by the low performance segments 24a, 24b flow through both caps.

An electrical source for energizing the coil assembly 22 is coupled to coil 22a by a flexible ribbon cable (not shown) which permits the assembly to travel freely along the stroke path. When a current flow through the coil is in a first direction, a magnetic field is produced by the coil which causes the assembly 22 to translate along the path in a first direction. When the current flow is reversed, the coil assembly translates in the opposite direction. Opposing movement can also be created by cutting off current flow and using a spring, or the like, for returning the coil assembly to a home position.

The higher performance magnetic material of magnetic segments 26a, 26b will produce a substantially greater flux density in the air gap 28 adjacent the magnets than in the air gap adjacent the lower performance magnetic segments 24a, 24b. As is well known, the driving force applied to coil assembly 22 is proportional to the product of the flux density in the air gap and the current flow through the coil. Accordingly, for a constant current flow, the driving force created by coil assembly 22 will be substantially greater when the assembly is in the stroke region of magnetic segments 26a, 26*b* than when in the region of magnetic segments 24*a*, 24*b*.

Assuming that the subject linear actuator is used, by way of example, in a plotter for driving a plotter pen, the actuator would be configured to move the pen from a home position to a marking position adjacent the paper. Since a relatively small force is adequate for this purpose, the low performance magnetic material would be disposed along the corresponding portion of the stroke path. When the pen is to be applied to the paper, a greater force is required. A higher performance magnetic material can be used along that relatively short portion of the stroke path so as to provide an increased drive force.

Heretofore, the largest amount of drive force required of a linear actuator at any stroke position dictates the magnetic material to be used along the entire stroke path. In the present invention, high performance, and high cost, magnetic material is used only in those locations along the stroke path where a high drive force is necessary. In order to obtain the full benefits of the subject invention, the difference in air gap flux density should be at least 25%.

A further advantage of the present invention is that the dimensions of soft iron core 10, end caps 12, 13 and side plates 18 may be reduced. If relatively high performance magnetic material were used along the entire stroke path, the total magnetic flux in the soft iron elements would be increased. As a result, the dimension of the iron elements would have to be increased to avoid saturation. Increased dimensions would increase the weight of the actuator and manufacturing costs. By utilizing only high performance magnetic materials where required, the flux density is reduced substantially, thereby permitting smaller iron elements to be used.

Thus, a novel variable force linear actuator has been disclosed. Although a preferred embodiment has been described in some detail, certain changes could be made by those skilled in the art without departing from the spirit and scope of the invention, as defined by the appended claims. By way of example, one of the end caps 12, 14 could be deleted so as to provide a single-ended actuator as opposed to a double-ended actuator. The dimensions could also obviously be changed, depending upon the requirements of the actuator. The dimensions of the various iron elements should be selected so that the flux density in the elements is approximately uniform and such that saturation will not occur. Inasmuch as there is flux leakage in the side plates 18, the cross-sectional area of the side plates 18 should be slightly larger than that of core 10 to accommodate leakage flux which does not reach the core. In addition, a central core having an elongated rectangular cross-section could be used in lieu of a cylindrical core. In that event, the magnetic segments and side plates also have an elongated cross-section, as does the coil assembly. The guide and drive members extend away from the coil assembly between the opposing magnetic segments and side plates. Also, rather than utilizing magnetic segments having different energy products, the air gap flux density can be varied utilizing magnetic segments of the same energy product and varying the thickness of the magnetic segments along the length of the stroke path. This approach is most advantageous in those applications where the thickness of the magnetic segments (pole-to-pole) is relatively large in comparison to the width of the air gap.

I claim:

1. An electromechanical actuator comprising:

magnet means for producing a magnetic flux along an actuator stroke path, said magnetic flux having a first flux density at a first region along said stroke path and a second flux density, substantially different from said first flux density, at a second region along said stroke path, said magnet means including a first permanent magnet disposed along said first stroke path region and a second permanent magnet disposed along said second stroke path region; and a coil assembly moveable along said stroke path, said assembly including a coil having at least one electrical conductor present in said magnetic flux.

2. The actuator of claim 1 wherein said magnet means includes a core having a longitudinal axis which extends along said stroke path and wherein said coil encircles said core.

3. The actuator of claim 2 wherein said magnetic flux is produced in an air gap and is generally normal to said core longitudinal axis and said coil is disposed in said air gap.

4. The actuator of claim 3 wherein said magnet means includes a first side plate which extends along said stroke path and which is spaced apart from said core.

5. The actuator of claim 4 wherein said first permanent magnet is disposed between said first side plate and said core along said first stroke path region and said second permanent magnet is disposed between said first side plate and said core along said second stroke path region.

6. The actuator of claim 5 wherein said first and second permanent magnets are secured to said first side plate, with said air gap being disposed between said magnets and said core.

7. The actuator of claim 6 wherein said first and second permanent magnets have substantially different energy products.

8. The actuator of claim 7 wherein said magnet means further includes a second side plate which extends along said stroke path and which is spaced apart from said core, with said first and second side plates being disposed on opposite sides of said core.

9. The actuator of claim 8 wherein said magnet means further includes a third permanent magnet disposed between said second side plate and said core along said first stroke path region and a fourth permanent magnet disposed between said second side plate and said core along said second stroke path region.

10. The actuator of claim 9 wherein said first and second permanent magnets have substantially the same energy product as said third and fourth permanent magnets, respectively.

11. The actuator of claim 10 wherein said core is cylindrical and said first and second side plates have a generally arcuate cross-section and are spaced apart from one another so as to define therebetween first and second slots on opposite sides of said core which extend along said stroke path.

12. The actuator of claim 11 wherein said coil assembly includes a guide member which extends from said coil through said first slot and a drive member which extends from said coil through said second slot.

13. The actuator of claim 12 wherein said magnet means includes a first cap element for securing said first and second side plates to a first end of said core.

14. The actuator of claim 13 wherein said magnet means includes a second cap element for securing said first and second side plate to a second end of said core.

15. The actuator of claim 13 wherein said core, said first and second side plates and said first cap are fabricated from a ferromagnetic material.

16. An electromechanical actuator comprising:

a coil assembly moveable along an actuator stroke path, said assembly including a coil having at least one electrical conductor; and a magnetic circuit which includes:

a first magnet positioned with respect to said stroke path so as to produce a magnetic flux having a first flux density which is normal to said stroke path and which is disposed at a first region along said path, and a second magnet positioned with respect to said stroke path so as to produce a magnetic flux having a second flux density which is normal to said stroke path, which is disposed at a second region along said path and with said second flux density being substantially different than said first flux density.

17. The actuator of claim 16 wherein said magnetic circuit includes a core having a longitudinal axis which extends along said stroke path and wherein said coil encircles said core.

18. The actuator of claim 17 wherein said magnetic flux is produced in an air gap and said coil is disposed in said air gap.

19. The actuator of claim 18 wherein said magnetic circuit includes a first side plate which extends along said stroke path and which is spaced apart from said core.

20. The actuator of claim 19 wherein said first magnet is disposed between said first side plate and said core along said first stroke path region and said second magnet is disposed between said first side plate and said core along said second stroke path region.

21. The actuator of claim 20 wherein said first and second magnets are permanent magnets and are secured to said first side plate, with said air gap being disposed between said magnets and said core.

22. The actuator of claim 21 wherein said first and second permanent magnets have substantially different energy products.

23. The actuator of claim 22 wherein said magnetic circuit further includes a second side plate which extends along said stroke path and which is spaced apart from said core, with said first and second side plates being disposed on opposite sides of said core.

24. The actuator of claim 23 wherein said magnetic circuit means further includes a third permanent magnet disposed between said second side plate and said core along said first stroke path region and a fourth permanent magnet disposed between said second side plate and said core along said second stroke path region.

25. The actuator of claim 24 wherein said first and second permanent magnets have substantially the same energy product as said third and fourth permanent magnets, respectively.

26. The actuator of claim 25 wherein said core is cylindrical and said first and second side plates have a generally arcurate cross-section and are spaced apart from one another so as to define there between first and second slots on opposite sides of said core which extend along said stroke path.

27. The actuator of claim 26 wherein said coil assembly includes a guide member which extends from said coil through said first slot and a drive member which extends from said coil through said second slot.

28. The actuator of claim 27 wherein said magnet means includes a first cap element for securing said first and second side plates to a first end of said core.

29. The actuator of claim 28 wherein said magnet means includes a second cap element for securing said first and second side plate to a second end of said core.

30. The actuator of claim 28 wherein said core, said first and second side plates and said first cap are fabricated from a ferromagnetic material.

* * * * *